US008742652B2

(12) United States Patent
Niessner

(10) Patent No.: US 8,742,652 B2
(45) Date of Patent: Jun. 3, 2014

(54) HF IGNITION DEVICE

(75) Inventor: Werner Niessner, Steinheim (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 668 days.

(21) Appl. No.: 13/086,168

(22) Filed: Apr. 13, 2011

(65) Prior Publication Data

US 2011/0290208 A1 Dec. 1, 2011

(30) Foreign Application Priority Data

Jun. 1, 2010 (DE) ..... 10 2010 022 334

(51) Int. Cl.
*H01T 13/08* (2006.01)

(52) U.S. Cl.
USPC ..... 313/141; 313/143; 123/169 EL

(58) Field of Classification Search
None
See application file for complete search history.

(56) References Cited

U.S. PATENT DOCUMENTS

| | | | | |
|---|---|---|---|---|
| 6,590,318 | B2 * | 7/2003 | Nishikawa et al. | 313/143 |
| 2008/0309214 | A1 * | 12/2008 | Niessner et al. | 313/143 |
| 2011/0253089 | A1 * | 10/2011 | Braeuchle et al. | 123/143 B |
| 2013/0199484 | A1 * | 8/2013 | Stifel et al. | 123/143 B |

FOREIGN PATENT DOCUMENTS

EP 1 515 594 A2 3/2005

* cited by examiner

*Primary Examiner* — Ashok Patel
(74) *Attorney, Agent, or Firm* — Hackler Daghighian & Martino

(57) ABSTRACT

Described is an HF ignition device for igniting a fuel in an internal combustion engine, comprising a ceramic insulator which carries an ignition electrode and encloses an inner conductor leading to the ignition electrode, and an outer conductor which encloses the insulator and, together with a section of the inner conductor, forms a capacitor which is part of a circuit for the HF excitation of the ignition electrode. According to the invention, the insulator is part of a ceramic body which comprises an inner region which is composed of an electrically conductive ceramic and is enclosed by the insulator, and an outer region which is composed of an electrically conductive ceramic and encloses the insulator.

8 Claims, 1 Drawing Sheet

8
9
10
11
6
13
16
15
14b
14a
12a
12
12b

4a
H
3
2
1
5

4
3
1
2

HF IGNITION DEVICE

The invention is directed to a high-frequency ignition device. An HF ignition device for inducing ignition by a corona discharge is known from EP 1 515 594 A2.

To ignite a combustible gas mixture in an engine, the ignition electrode of such an HF ignition device is excited using a suitable circuit, e.g. an HF oscillating circuit. The ignition electrode then radiates high-frequency electromagnetic waves into the combustion chamber of the engine, thereby creating a plasma that induces ignition.

HF ignition devices inducing ignition by a corona discharge are an alternative to conventional spark plugs which induce ignition by an arc discharge and are subject to considerable wear due to electrode erosion. HF ignition devices have the potential to achieve a longer service life, although this has not happened yet.

A conventional spark plus is known from DE 10 2007 027 319 A1. This spark plug has a ceramic insulator which encloses a ceramic inner conductor and is manufactured by coextrusion.

SUMMARY OF THE INVENTION

The problem addressed by the present invention is therefore that of demonstrating a way to improve the service life of an HF ignition device.

This problem is solved by an HF ignition device for ignition fuel by a corona discharge having the features indicated in claim 1. Advantageous refinements of the invention are the subject matter of dependent claims.

To excite the ignition electrode to emit high-frequency electromagnetic waves and to create a corona discharge, an HF ignition device contains a circuit, typically an oscillating circuit or e.g. a piezoelectric HF generator. One element of this circuit is a capacitor, the dielectric of which is formed by an insulator which encloses an inner conductor leading to the ignition electrode.

For frequencies of typically at least one MHz and voltages of a few kV, the dielectric strength during operation has proven to be problematic. Voltage overloads and partial discharges often cause an HF ignition device to fail prematurely.

Surprisingly, the dielectric strength can be markedly improved by designing the insulator as part of a ceramic body which comprises an inner region which is composed of an electrically conductive ceramic and is enclosed by the insulator, and an outer region which is composed of an electrically conductive ceramic and encloses the insulator.

In the case of an HF ignition device according to the invention, the capacitor is therefore formed by a ceramic body comprising a ceramic insulator as the dielectric, which is located between an inner region composed of an electrically conductive ceramic and an outer layer composed of an electrically conductive ceramic. In the case of a ceramic body of that type, cavities can be prevented from forming between the two electrical conductors and the dielectric of the capacitor, thereby resulting in greater dielectric strength.

In the case of capacitors of conventional HF ignition devices, gas-filled cavities between the electrical conductors and the dielectric of the capacitor, such as air gaps, shrinkage cavities, pores, or cracks, pose a tenacious problem and promote the development of shunts and electrical partial discharges which commonly cause malfunctions and premature failure. By preventing the development of cavities between the dielectric and the two conductors of the capacitor, the service life of an HF ignition device according to the invention can be extended.

The ceramic body of an HF ignition device according to the invention can be manufactured by coextrusion. Preferably, the same ceramic material is used for the conductive material that is enclosed by the insulator and for the conductive material that encloses the insulator. Advantageously, only two materials are therefore required for coextrusion, namely an insulating ceramic and an electrically conductive ceramic.

In a method for manufacturing an HF ignition device according to the invention, the first step is to manufacture a green body by coextrusion, which comprises a core composed of a conductive ceramic material, a region composed of an electrically insulating ceramic material and enclosing the core, and a jacket composed of electrically conductive ceramic material. By sintering such a green body, preferably pressure sintering, a ceramic body is manufactured that can be used as a capacitor. An ignition electrode is then attached to the ceramic body in an electrically conductive connection to the conductive core.

The green body can be processed further before sintering. For example, the jacket composed of electrically conductive ceramic material can be removed in an end section. Another way to process the green body is to bore a channel therethrough or to widen an existing channel. After sintering, a metal pin can be inserted into such a channel, which then forms the inner conductor together with the electrically conductive ceramic material. Preferably, the inner conductor also comprises a glass sealing which plugs the channel extending through the ceramic body in a pressure-tight manner. Glass material based on silicon oxide, which was made electrically conductive via the addition of metal or carbon particles, can be used for the glass sealing.

The inner conductor of an HF ignition device according to the invention can be formed solely by the electrically conductive ceramic material. In that case the ceramic body is solid, e.g. without a channel, or comprises only a blind hole into which the ignition electrode or a metal pin carrying it has been inserted. The ceramic body preferably comprises a continuous channel, however, in which a metallic conductor is disposed. In that case, the inner conductor is formed by a metallic conductor pin, which extends through the channel, and the electrically conductive ceramic material which is enclosed by the insulator.

It is possible to use silicides, carbides, borides, nitrides, and oxides, for instance, for the insulator of an HF ignition device according to the invention. Aluminum oxide or silicon nitride are particularly suitable. An electrically conductive ceramic material can be created for the inner and/or outer region of the ceramic body by adding electrically conductive material, preferably conductive ceramic material such as titanium nitride, lanthanum chromium oxide, or molybdenum silicide, to an insulating ceramic material. Titanium nitride or lanthanum chromium oxide, in particular, can be added to aluminum oxide. Ceramic material based on silicon nitride can be made conductive in a particularly advantageous manner by adding molybdenum silicide.

BRIEF DESCRIPTION OF THE DRAWINGS

Further details and advantages of the invention are explained using an embodiment, with reference to the attached figures. They show.

DETAILED DESCRIPTION

Figure 1:
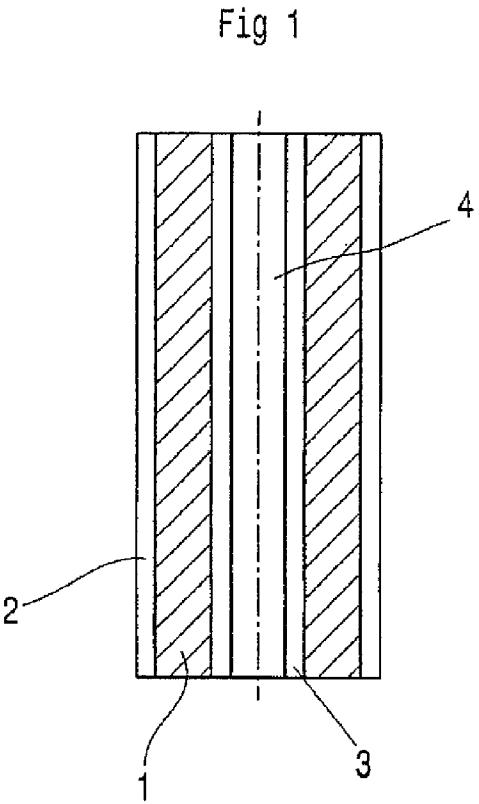
FIG. 1 a green body for the manufacture of an ignition device.

To manufacture an HF ignition device, the first step is to produce a green body—which is depicted in FIG. 1—by coextrusion. The green body comprises a core composed of an electrically conductive ceramic material 3, a layer of an electrically insulating ceramic material 1 enclosing the core, and an outer layer of an electrically conductive ceramic material 2. Such a green body can be manufactured as a solid cylinder into which channel 4 depicted in FIG. 1 is subsequently drilled. It is also possible to extrude the green body with channel 4 already in place.

Electrically insulating layer 1 is preferably composed of aluminum oxide or silicon nitride. Electrically conductive ceramic material 2, 3, between which electrically insulating layer 1 is placed, can be manufactured on the basis of the same insulating ceramic material which is made electrically conductive by the addition of electrically conductive additives such as manganese silicide or lanthanum chromium oxide.

Figure 2:
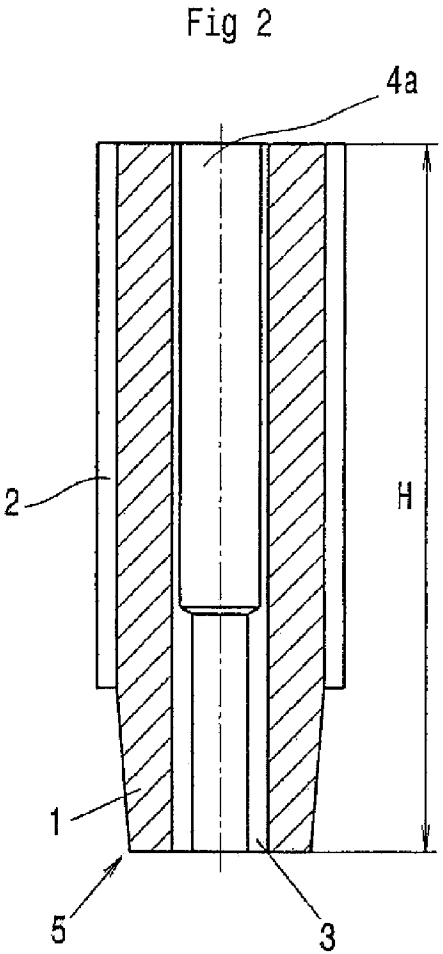
FIG. 2 a ceramic body made from the green body.

In a further processing step, electrically conductive outer layer 2 is removed in an end region of the green body, e.g. by lathe cutting. The green body may than be conically tapered in this front region which is not covered by the electrically conductive ceramic, as shown in FIG. 2. In the embodiment, a stepped bore 4*a* which widens continuous channel 4 is also formed in the green body. Stepped bore 4*a* is sized such that the inner side of the green body is composed of electrically conductive ceramic material 3 in the bored region as well.

Next, the green body is sintered under pressure, and ceramic body 5 created as a result is used to produce the HF ignition device for ignition fuel in an internal combustion engine by a corona discharge. The HF ignition device is depicted schematically in FIG. 3.

Figure 3:
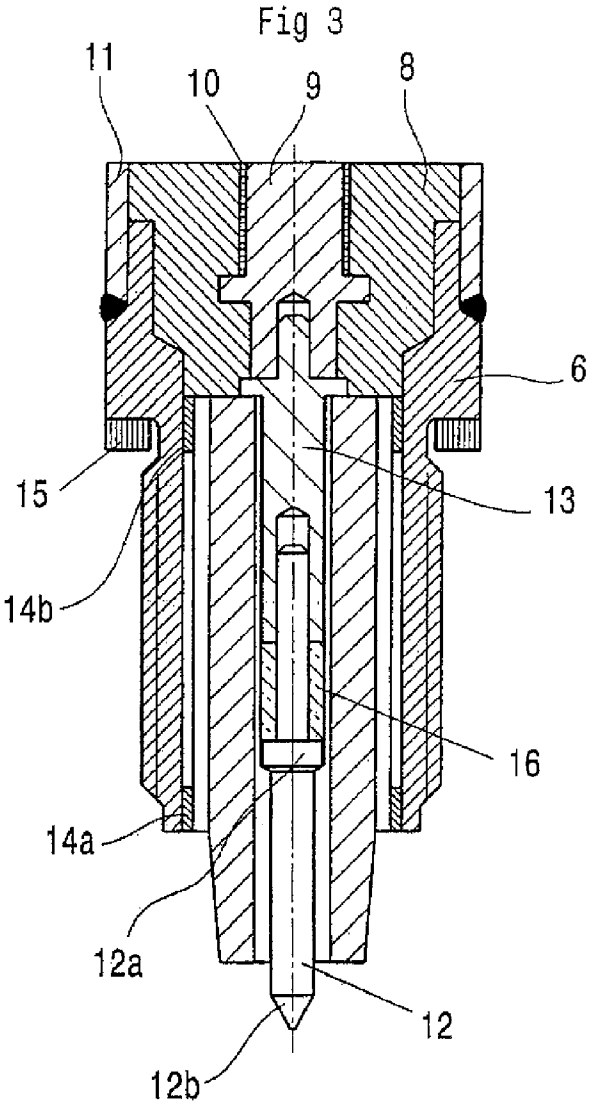
FIG. 3 an HF ignition device comprising the ceramic body depicted in FIG. 2.

As shown in FIG. 3, a metal pin 12, as part of the inner conductor, is inserted into ceramic body 5. In the embodiment shown, metal pin 12 extends out of the end of the ceramic body facing the combustion chamber, where it forms ignition electrode 12*b*. The channel extending through ceramic body 5 is sealed with a glass sealing 16 which encloses metal pin 12. As an alternative or in addition thereto, metal pin 12 can also be soldered or brazed into ceramic body 5, especially by active brazing.

Metal pin 12 preferably comprises a section 12*a* having a widened diameter, which rests against a shoulder of channel 4 extending through ceramic body 5. Section 12*a* and the shoulder of channel 4 can bear against one another by way of conical annular surfaces. An end section of metal pin 12 opposite the combustion chamber is connected to a contact pin 13 in an electrically conductive manner. Preferably, contact pin 13 and metal pin 12 are inserted into one another. An electrical contact between contact pin 13 and metal pin 12 can also be achieved, however, by abutting same via end surfaces thereof, or by connecting same using an electrically conductive filling compound such as glass, brazing material, solder, or conductive adhesive.

In the embodiment shown, metal pin 12 which forms the inner conductor is connected to a coil 10 which is part of a circuit for the HF excitation of the ignition electrode. Instead of a coil, it is also possible to use a piezoelectric HF generator, for example. A further part of the circuit for the HF excitation of ignition electrode 12*b* is the capacitor formed by ceramic body 5, the dielectric of which is electrically insulating ceramic material 1.

The end of the HF ignition device opposite the combustion chamber is not depicted in FIG. 3. The beginning of coil 10, which is connected to the inner conductor, and associated coil body 9 are shown, however.

Ceramic body 5 is inserted into a metallic housing part 6 which comprises an outer thread in the embodiment shown. Instead of an outer thread, an insertion solution using an anchoring attachment, for instance, can be used for installation on the cylinder of an internal combustion engine.

In the embodiment shown, ceramic body 5 is connected to housing part 6 by way of one or more metal sleeves 14*a*, 14*b*, to enable the ceramic body to be pressed into housing part 6. Two metal sleeves are provided in the embodiment shown, which are so short that they can also be referred to as rings. Metal sleeves 14*a*, 14*b* are soldered or brazed onto electrically conductive outer layer 2 of ceramic body 5, or are bonded using a conductive adhesive. Ceramic body 5 can be connected per se or directly to housing part 6, by soldering, for example.

In the embodiment shown, the part of the housing near the combustion chamber, i.e. housing part 6, is connected to a further housing part, i.e. tube 11, by brazing or soldering, for example. The inner space enclosed by the housing is filled with an electrically insulating casting compound 8 which encloses coil 10 in the embodiment shown.

The two housing parts 6, 11 are welded together in the embodiment shown. A seal 15 which rests on housing part 6 on the side next to the combustion chamber is shown in FIG. 3.

The inner conductor of an HF ignition device is often referred to as a center electrode. As is the case with the embodiment shown, the center electrode can transition into the ignition tip which can have any shape. It is also possible to design the ignition tip as an additional part which can be made of a metal alloy that is resistant to erosion, for example. Metal pin 12 can be homogeneous in design or, to improve conductivity, can comprise a copper core which is enclosed by a refractory metal.

REFERENCE NUMERALS

1 Electrically insulating ceramic material
2 Electrically conductive ceramic material
3 Electrically conducting ceramic material
4 Channel
4*a* Stepped bore
5 Ceramic body
6 Housing part
8 Casting compound
9 Coil body
10 Coil
11 Housing part
12 Metal pin
12*a* Section
12*b* Ignition electrode
13 Contact pin
14*a* Metal sleeve
14*b* Metal sleeve
15 Seal
16 Glass sealing

What is claimed is:

1. An HF ignition device for igniting a fuel in an internal combustion engine, the device comprising:

a ceramic insulator carrying an ignition electrode and enclosing an inner conductor leading to the ignition electrode; and an outer conductor enclosing the ceramic insulator and, together with a section of the inner conductor, forming a capacitor, said capacitor being a part of a circuit for HF excitation of the ignition electrode, wherein the ceramic insulator is part of a ceramic body which comprises an inner region composed of an electrically conductive ceramic and enclosed by the ceramic insulator, and an outer region composed of an electrically conductive ceramic enclosing the insulator.

2. The HF ignition device according to claim 1, wherein the inner conductor comprises a metal pin which is inserted into the ceramic body.

3. The HF ignition device according to claim 2, wherein the ceramic body comprises a continuous channel into which the metal pin is inserted.

4. The HF ignition device according to claim 2, wherein the channel is a stepped bore.

5. The HF ignition device according to claim 2, wherein the channel is sealed with a glass sealing.

6. The HF ignition device according to claim 1, wherein the electrically conductive ceramic enclosing the insulator leaves an end section of the insulator facing the combustion chamber uncovered.

7. The HF ignition device according to claim 1, wherein the ceramic body has a reduced diameter on the end thereof facing the combustion chamber.

8. The HF ignition device according to claim 1, wherein the outer region of the ceramic body, which is composed of an electrically conductive ceramic and encloses the insulator, is brazed with a metal sleeve.

* * * * *